US006485167B2

(12) United States Patent
Liang et al.

(10) Patent No.: US 6,485,167 B2
(45) Date of Patent: Nov. 26, 2002

(54) LIGHT DEVICE WITH HEAT-DISSIPATING APPARATUS

(75) Inventors: Don Liang, Chungli (TW); Kan-Chuan Cheng, Taoyuan (TW); Jyh-Min Lai, Kaohsiung (TW)

(73) Assignee: Acer Communications & Multimedia Inc., Taoyuan (TW)

( * ) Notice: Subject to any disclaimer, the term of this patent is extended or adjusted under 35 U.S.C. 154(b) by 0 days.

(21) Appl. No.: 09/865,604

(22) Filed: May 29, 2001

(65) Prior Publication Data

US 2002/0136015 A1 Sep. 26, 2002

(30) Foreign Application Priority Data

Mar. 26, 2001 (TW) ..... 90107110

(51) Int. Cl.[7] ..... F21V 29/02
(52) U.S. Cl. ..... 362/373; 362/294
(58) Field of Search ..... 362/373, 294, 362/96; 353/52, 57, 58, 56

(56) References Cited

U.S. PATENT DOCUMENTS 1,824,388 A * 9/1931 Birch ..... 362/96
3,492,069 A * 1/1970 Kapilow ..... 353/101
3,639,751 A * 2/1972 Pichel ..... 362/261
3,642,361 A * 2/1972 Streu ..... 313/25
4,841,422 A * 6/1989 Groh ..... 362/294
6,004,010 A * 12/1999 Inage et al. ..... 362/294

* cited by examiner

*Primary Examiner*—Sandra O'Shea
*Assistant Examiner*—Hargobind S Sawhney
(74) *Attorney, Agent, or Firm*—Nixon Peabody LLP; Donald R. Studebaker

(57) ABSTRACT

The present invention relates to a light device with a heat-dissipating apparatus, including a bulb assembly and a hood positioned outside the bulb assembly to generate cyclone passing by the outer surface of the bulb assembly. The hood of the present invention further includes a plurality of blades and a neck. As the airflow passes through the hood, the blades and the neck divert the airflow into cyclone passing by the outer surface of the bulb assembly to facilitate heat dissipation. The present invention may further include a first heat-isolating board and a second heat-isolating board to isolate heat radiation.

9 Claims, 5 Drawing Sheets

LIGHT DEVICE WITH HEAT-DISSIPATING APPARATUS

FIELD OF THE INTENTION

The present invention relates to a light device and, more particularly, to a light device with a heat-dissipating apparatus.

BACKGROUND OF THE INVENTION

Light devices currently tend to use high-watt bulbs. For example, bulbs in a projector may have such high power as 200 watts. In this case, it is desired to have a light device with a heat-dissipating apparatus, which works fast and efficiently.

Generally, a fan is used in a light device in order to dissipate the heat generated by the light device. However, the surface temperature of the light device without efficient heat-dissipating apparatuses may exceed the upper limit of the regular temperature. This kind of light device might hurt users and is not qualified to the safety examination.

To solve the heat-dissipating problems mentioned above, the present invention provides a light device with a feasible efficient heat-dissipating apparatus.

SUMMARY OF THE INVENTION

The present invention discloses a light device with a heat-dissipating apparatus, including a bulb assembly and a hood positioned outside the bulb assembly. Cyclone is generated when airflow passes through the hood. While flowing by the outer surface of the bulb assembly, the cyclone takes away most of the heat. The temperature of the outer surface is then lowered. The present invention may further include a first heat-isolating board and a second heat-isolating board to isolate the heat radiation.

The aforementioned hood preferably includes a neck, at least one accommodation portion, and a plurality of blades. The blades are located between the neck and the accommodation portion. As airflow is generated by a fan and passes through the blades of the hood, it turns into cyclone and flows by the outer surface of the bulb assembly. The cyclone then takes away the heat thereon.

There are many advantages of employing the hood for the light device. The cyclone generated by the hood has such a high speed that it quickly takes away the heat. Moreover, the hood increases the flow path and the flowing time of the cyclone so that the heat-dissipating efficiency is improved. Also, the cyclone may almost reach every single corner of the light device and therefore the heat-dissipating rate of the cyclone is increased. The surface temperature of the bulb assembly is uniformly distributed more easily.

The design of the hood disclosed in the present invention may dissipate the heat more efficiently and quickly, and the light device of the present invention can meet the safety regulation.

DETAILED DESCRIPTION OF THE PRESENT INVENTION

Figure 1:
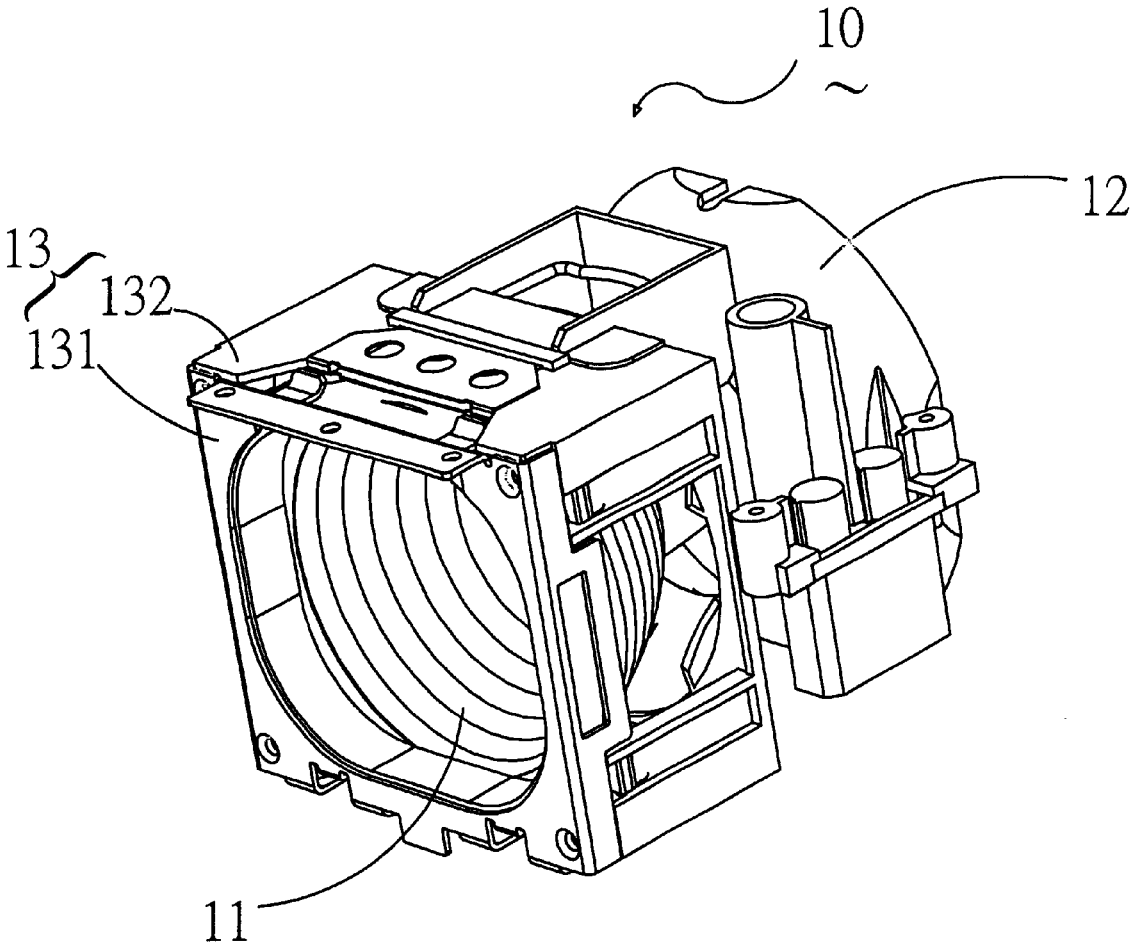
FIG. 1 illustrates the light device according to the present invention in an assembly form.

FIG. 1 illustrates the light device 10 according to the present invention in an assembly form. According to an embodiment, the light device 10 disclosed in the present invention includes a bulb assembly 11 and a hood 12. Preferably, the light device 10 further includes a connection frame 13 to connect the bulb assembly 11 with the hood 12. The connection frame 13 may include a front frame 131 and multiple holding frames 132.

Figure 2:
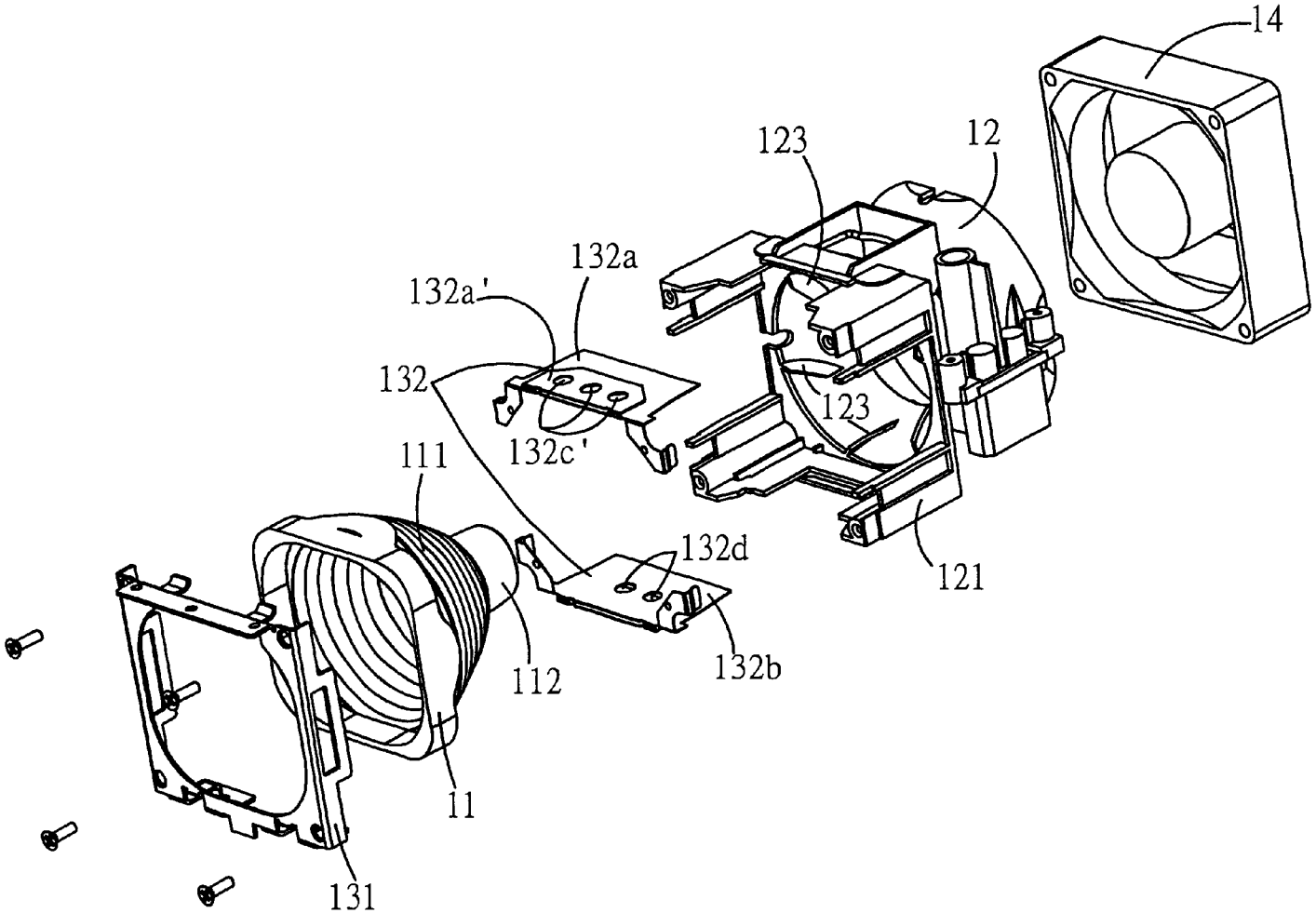
FIG. 2 illustrates the light device according to the present invention in an explosive form.
Figure 3A:
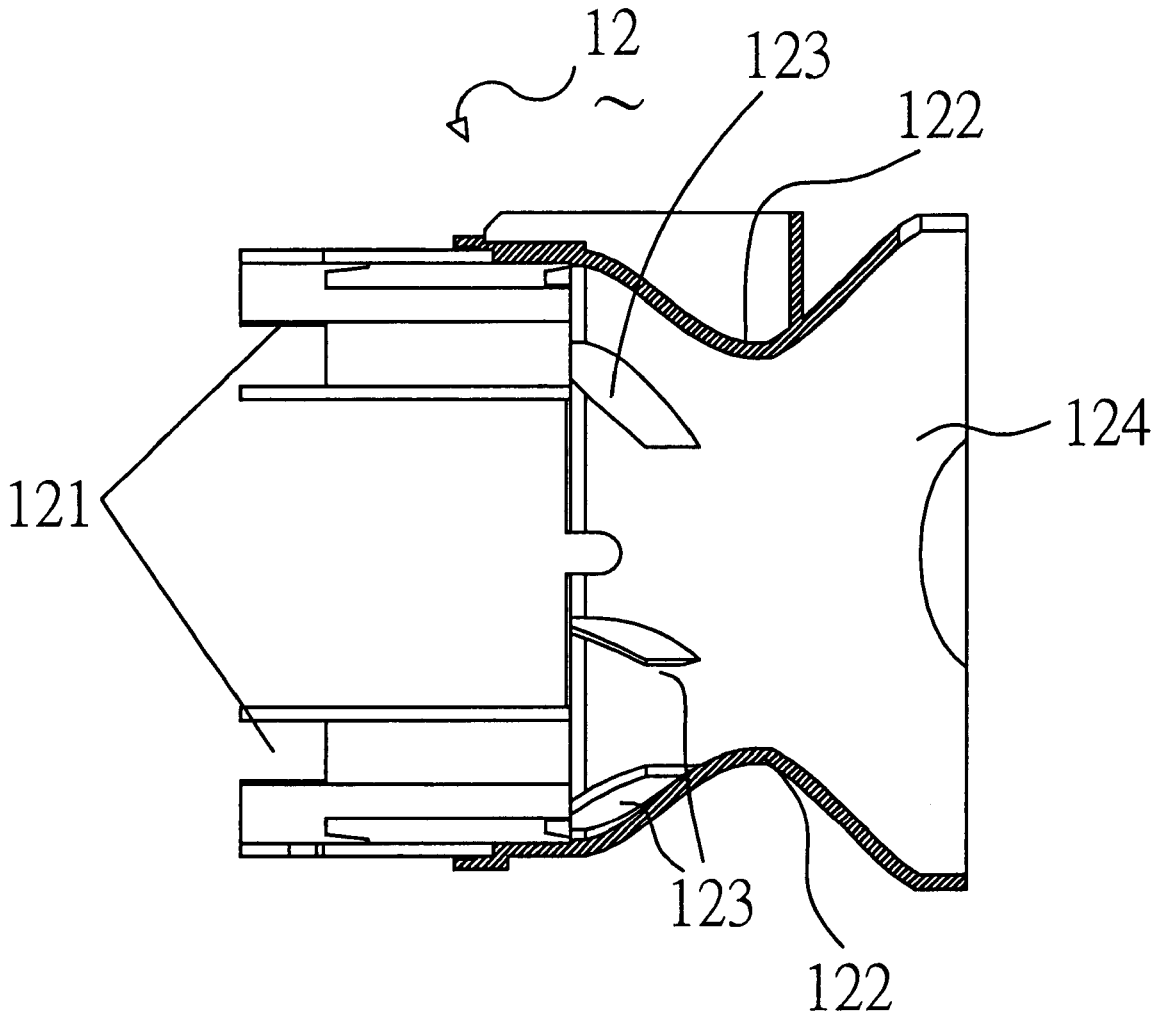
FIG. 3A illustrates the cross-sectional view indicating the profile of the hood according to the present invention.
Figure 3B:
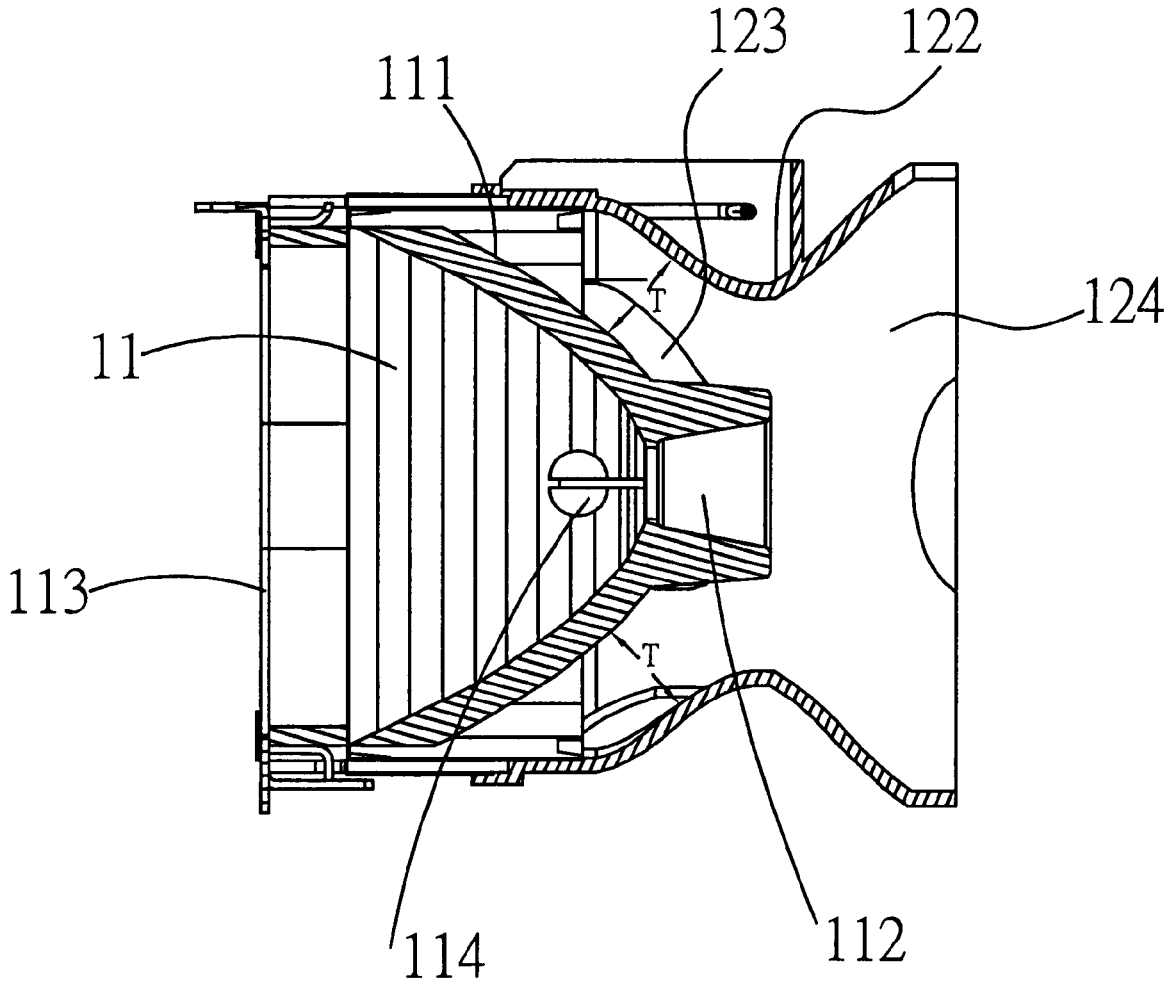
FIG. 3B illustrates the connection of bulb assembly to the hood.

FIG. 2 illustrates the light device 10 according to the present invention in an explosive form. The hood 12 includes a neck 122, as shown in FIG. 3A and 3B, and a plurality of blades 123 positioned between the neck 122 and an accommodation portion 121. The multiple blades 123 are distributed along the inner circumference of the hood 12. More preferably, the present invention further includes a fan 14 to produce the airflow. The airflow passes through the conduit defined by the plurality of blades 123 of the hood 12 and forms the cyclone to take away the heat on the outer surface 111 of the bulb assembly 11.

The airflow is generated when the fan 14 is turned on, and is then diverted due to the streamline shapes of the blades 123 (also shown in FIG. 3A) of the hood 12. The blades 123 are designed to have streamline shapes to speed up the cyclone while passing by the outer surface 111 of the bulb assembly 11. The created cyclone then flows along the outer surface 111 of the bulb assembly 11 and takes away most of the heat.

As shown in FIG. 2, the connection frame 13 includes a front frame 131 and multiple holding frames 132 respectively connected to the accommodation portion 121 of the hood 12 by connecting devices, such as screws, to fix the bulb assembly 11 with the hood 12. The front frame 131 is located in front of the light emitting surface 113 (as shown in FIG. 3B) of the bulb assembly 11 and is connected to the light emitting surface 113.

Furthermore, each holding frame 132 includes a first heat-isolating board 132*a* and a second heat-isolating board 132*b*. The first heat-isolating board 132*a* includes a first outer board 132*a*', with holes 132*c* (shown in FIG. 4) and 132*c*' provided respectively. The second heat-isolating board 132*b* includes a second outer board 132*b*', with holes 132*d* and 132*d*' (shown in FIG. 4) provided respectively in the same way. The first heat-isolating board 132*a* is connected to the front frame 131 and the accommodation portion 121 respectively. Also, the second heat-isolating board 132*b* is connected to the front frame 131 and the accommodation portion 121 respectively in the same way. As a result, the bulb assembly 11 and the hood 12 connect to each other by means of the connection frame 13 and the accommodation portion 121.

FIG. 3A illustrates the cross-sectional view indicating the profile of the hood 12 according to the present invention, and FIG. 3B illustrates the cross-sectional view indicating the profile of the hood 12 along with the bulb assembly 11. The rear portion 112 of the bulb assembly 11 is located at the neck 122 of the hood 12 when assembled. In order to eliminate the noise caused by the airflow passing through the tunnel formed by the neck 122, the hood 12 further includes an enlarged space, located between the fan 14 and the neck 122, to function as a noise elimination portion 124. The bulb assembly 11 is composed of an outer surface 111, a light emitting surface 113, a luminous body 114, and a rear portion 112. The distance T between the outer surface 111 of the bulb assembly 11 and the inner surface of the hood 12 is substantially a constant. In one of the embodiments, the distance T is preferably ranged from 10 to 15 mm.

Figure 4:
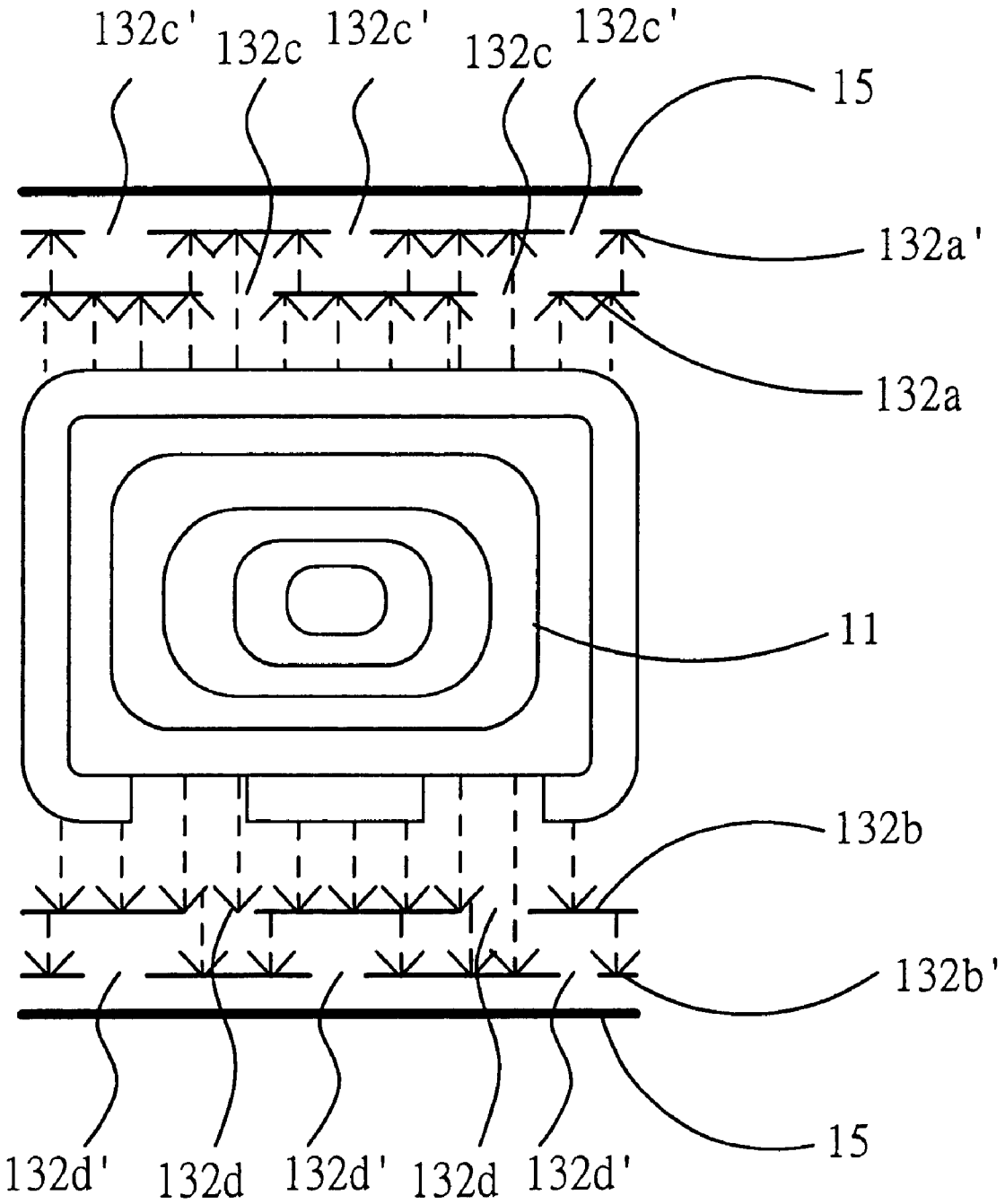
FIG. 4 illustrates a simplified sketch explaining how the heat with the airflow passes through the heat-isolating boards according to the present invention.

FIG. 4 illustrates the simplified sketch explaining how the heat with the airflow passes through the heat-isolating boards according to the present invention. Although the heat-isolating boards 132*a* and 132*b*, the outer boards 132*a*' and 132*b*', and the outer shell 15 shown in FIG. 4 are represented by line segments, each of the boards actually has a thickness. The line segments in FIG. 4 are only used to explain how the airflow passes through the heat-isolating boards for the simplicity reason. The horizontal projections of the holes 132*c* and 132*c*' are interleaving to one another. Part of the heat may transmit to the space between the first heat-isolating board 132*a* and the first outer board 132*a*' by way of the holes 132*c*. Because the horizontal projections of the holes 132*c* and 132*c*' are interleaving to one another, however, the heat would not transmit via the holes 132*c*' directly and may stay at the space between the first heat-isolating board 132*a* and the first outer board 132*a*'. The heat may then be carried away by the airflow generated by the fan 14, as shown in FIG. 2. Similarly, space is provided between the first outer board 132*a*' and the outer shell 15. The heat transmitted via the holes 132*c*' may also be carried away by the airflow generated by the fan 14. It results in a better heat-isolating effect. The same mechanism applies to the space between the second heat-isolating board 132*b* and the second outer board 132*b*', and also between the second outer board 132*b*' and the outer shell 15.

There are many advantages of employing the hood 12 for the light device 10. The cyclone generated by the hood 12 has such a high speed that it takes away the heat quickly. Moreover, the hood 12 increases the flow path and the flowing time of the cyclone so that the heat-dissipating efficiency is improved. That is, the flow path of the cyclone is longer than that of the linear airflow, and the heat-dissipating time is increased accordingly. Also, the cyclone may almost reach every single corner of the light device 10 and therefore the heat-dissipating rate of the cyclone may be increased. The surface temperature of the bulb assembly 11 may be uniformly distributed more easily. According to the experiment, the surface temperature of the bulb assembly 11 may substantially drop from 313° C. to 219° C. when employing the present invention.

The bulb assembly 11 of the present invention includes an outer surface 111, a rear portion 112, a light emitting surface 113, and a luminous body 114. The luminous body 114 may be a single bulb, a plurality of bulbs, or any other luminous component that may be applied to the present invention.

The hood 12 disclosed in the present invention may dissipate the heat more efficiently and quickly so that the light device 10 of the present invention is able to meet the safety regulation. It should be understood that the present invention is preferred, but not limited, to be adopted by a projector. Other applications of the subject light device 10 are falling into the scope of the present invention. Furthermore, any projector employing the disclosed light device 10 is also falling into the scope of the present invention.

It will be understood that certain features and sub-combinations are of utility and may be employed without reference to other features and sub-combinations as they are outlined within the claims. While the preferred embodiment and application of the invention has been described, it is apparent to those skilled in the art that the originals and features of the present invention are only limited as set forth in claims attached hereto.

What is claimed is:

1. A light device, comprising:

a bulb assembly having an outer surface; and a hood including a neck portion and a noise elimination portion located adjacent to said neck portion for eliminating noise caused by a flow of air through said neck portion, said hood being positioned outside said bulb assembly for generating cyclone passing by at least part of said outer surface of said bulb assembly, wherein the cross sectional area of said noise elimination portion is larger than the cross-sectional area of said neck portion.

2. The light device according to claim 1, wherein said hood comprises a plurality of blades.

3. The light device according to claim 1, wherein said hood comprises at least one accommodation portion.

4. The light device according to claim 3, wherein said hood includes a plurality of blades positioned between said neck portion and said at least one accommodation portion.

5. The light device according to claim 1, wherein said light device further comprises a fan generating airflow passing through said hood to form said cyclone.

6. A light device, comprising:

a bulb assembly including an outer surface and a light emitting surface;

a hood positioned outside said bulb assembly for generating cyclone passing by at least part of said outer surface of said bulb assembly;

a set of connection frames for connecting said bulb assembly to said hood, said set of connection frames including a front frame positioned outside said light emitting surface of said bulb assembly and at least one holding frame positioned outside said outer surface of said bulb assembly, wherein said hood includes at least one accommodation portion connected to said front frame and said at least one holding frame to thereby connect said bulb assembly to said hood.

7. The light device according to claim 6, wherein said at least one holding frame includes a heat-isolating board to dissipate heat radiation away from said bulb assembly.

8. The light device according to claim 7, wherein said heat-isolating board includes an outer board having at least one hole, said at least one hole having horizontal projections that are interleaving to one another to isolate the heat between said heat-isolating board and said outer board.

9. The light device according to claim 8, wherein a portion of the heat between said heat-isolating board and said outer board is carried away by airflow.

* * * * *

UNITED STATES PATENT AND TRADEMARK OFFICE

CERTIFICATE OF CORRECTION

PATENT NO. : 6,485,167 B2
DATED : November 26, 2002
INVENTOR(S) : Don Liang et al.

It is certified that error appears in the above-identified patent and that said Letters Patent is hereby corrected as shown below:

Title page,
Item [73], Assignee, delete "Acer Communications & Multimedia Inc.," add -- BENQ CORPORATION --.

Signed and Sealed this

Fifteenth Day of April, 2003

JAMES E. ROGAN
*Director of the United States Patent and Trademark Office*